US005238801A

United States Patent [19]

Ishigaki et al.

[11] Patent Number: 5,238,801

[45] Date of Patent: Aug. 24, 1993

[54] PROCESS OF TREATING A SILVER HALIDE PHOTOGRAPHIC ELEMENT

[75] Inventors: Kunio Ishigaki; Ken-ichi Kuwabara; Akira Hatakeyama, all of Kanagawa, Japan

[73] Assignee: Fuji Photo Film Co., Ltd., Kanagawa, Japan

[21] Appl. No.: 965,050

[22] Filed: Oct. 22, 1992

Related U.S. Application Data

[63] Continuation of Ser. No. 726,114, Aug. 31, 1992, abandoned, which is a continuation of Ser. No. 620,446, Dec. 3, 1990, abandoned, which is a continuation of Ser. No. 423,321, Oct. 18, 1989, abandoned.

[30] Foreign Application Priority Data

Oct. 19, 1988 [JP] Japan ..... 63-263257

[51] Int. Cl.[5] ..... G03C 1/85

[52] U.S. Cl. ..... 430/530; 430/349; 430/264

[58] Field of Search ..... 430/349, 530, 264

[56] References Cited

U.S. PATENT DOCUMENTS 4,495,276 1/1985 Takimoto et al. ..... 430/527

OTHER PUBLICATIONS

Hack's Chemical Dictionary Fourth Edition, 1969 pp. 2–3.

Perry's Chemical Engineer's Handbook, 6th ed., "Psychrometry", pp. 12–3, 12–4, McGraw-Hill Book Co., 1984.

*Primary Examiner*—Jack P. Brammer

*Attorney, Agent, or Firm*—Sughrue, Mion, Zinn, Macpeak & Seas

[57] ABSTRACT

A silver halide photographic material which has at least one silver halide emulsion layer on a support, wherein there is incorporated at least one electrically conductive layer of which the surface resistance is not more than $10^{12}$ Ω under conditions of 25° C., 25% RH, which photographic material has been dried out at a relative humidity of not more than 50% when the water content is not more than 300 wt% with respect to the total dry weight of the binder included in the silver halide emulsion layers and other hydrophilic layers on the support, which was subjected, after drying, to a heat treatment of duration at least 6 hours at a temperature of at least 30° C. in an atmosphere of absolute humidity not more than 0.01, and which has been stored under conditions of absolute humidity not more than 0.01.

12 Claims, No Drawings

PROCESS OF TREATING A SILVER HALIDE PHOTOGRAPHIC ELEMENT

This is a continuation of Ser. No. 07/726,114 filed Aug. 31, 1992 now abandoned, which is a continuation of grandparent application Ser. No. 07/620,446 filed Dec. 3, 1990, now abandoned, which is a continuation of great grandparent application Ser. No. 07/423,321 filed Oct. 18, 1989, now abandoned.

FIELD OF THE INVENTION

This invention concerns silver halide photographic materials and a method of forming ultra-high contrast negative images using these materials, and it is concerned, in particular, with silver halide photographic materials which are used in photographic plate making operations.

BACKGROUND OF THE INVENTION

A system of image formation which exhibits photographic characteristics of ultra high contrast (especially with gamma values of at least 10) is required in the graphic arts field for achieving good reproduction of continuous tone images by means of dot images, and for achieving the good reproduction of line images.

The methods in which hydrazine derivatives are used disclosed, for example, in U.S. Pat. Nos. 4,224,401, 4,168,977, 4,166,742, 4,311,781, 4,272,606, 4,221,857 and 4,269,929 are known methods in which high contrast photographic characteristics are obtained using stable development baths. With these methods, photographic characteristics of high speed with ultra high contrast are obtained and, since it is possible to add high concentrations of sulfite to the development baths, the stability of the development baths with respect to aerial oxidation is much better than that of a lith developer.

Furthermore, low speed light-room photosensitive materials which contain hydrazine derivatives as widely used in the reverse process in photographic plate making operations have been disclosed, for example, in JP-A-60-14038, JP-A-60-162246, JP-A-61-238049, JP-63-8846 and Japanese Patent Application Nos. 62-65116 and 62-218648. (The term "JP-A" as used herein signifies an "unexamined published Japanese patent application".)

On the other hand, the photographic plate making process has become more complicated as a result of the diversification of printing materials, and demands have arisen for rationalization of operation and improved energy conservation. Moreover, when photographing screened images and line drawings, or when making contact reverse exposures using ultra-high contrast sensitive materials, electrostatic charges accumulate as a result of contact friction arising from contact between the photosensitive materials themselves or contact with the surface of some other material, or peeling apart, and this causes dust to become attached to the photosensitive material or to the original film and traces of this dust remain as pin-holes after development processing. This is a problem in that these pin-holes must be repaired or the exposure must be made again. Techniques for improving the charging characteristics of the photosensitive materials, using surfactants for example, have been introduced to ameliorate such problems, but these techniques cannot be said to be adequate. Thus, the charging properties are lost when the material is developed and processed and there is virtually no improvement in respect of the aforementioned pin-holes when the film is subsequently used as an original.

Furthermore, changes in dimensions of the photographic material due to expansion or shrinkage of the hydrophilic colloid layers is a very serious disadvantage in the plate making processes when the reproduction of dot images and precise line drawings is required for multi-color printing.

Various devices have been used conventionally to improve the dimensional stability of silver halide photographic materials.

For example, a technique in which the ratio of the thicknesses of the hydrophilic colloid layer and the support is specified has been disclosed in the U.S. Pat. No. 3,201,250, and methods in which a polymer latex is added to the hydrophilic colloid photographic layers have been disclosed in JP-B-39-4272, JP-B 39 17702, JP-B-43-13482, JP-B-45-5331 and U.S. Pat. Nos. 237,600, 2,763,625, 2,772,166, 2,852,386, 2,853,457, 3,397,988, 3,411,911 and 3,411,912. (The term "JP-B" as used herein signifies an "examined Japanese patent publication".)

It is possible to improve the dimensional stability of silver halide photographic materials due to variations in temperature and humidity using these techniques.

However, it is not possible to prevent changes in dimensions which originate from the development processing of silver halide photographic materials using these techniques. The changes in dimensions which accompany development processing occur with silver halide photographic materials as a result of the development processing, the dimensions after development being different from those at the time of exposure, and this is a very serious problem when silver halide photographic materials are used.

A technique in which vinylidene chloride underlayers are used has been disclosed in Japanese Patent Application No. 62-94133 for improving the dimensional stability in respect of development processing.

However, it is not possible to ameliorate the problem of dimensional stability with respect to development processing completely using this technique.

These problems are of special importance in the case of silver halide photographic materials which exhibit ultra-high contrast in respect of rationalization of the plate making process industry, energy conservation and the improvement of printed material quality, and it is very desirable that silver halide photographic materials which are not liable to pin-hole formation and with which the change in dimensions is slight should be developed for this purpose.

SUMMARY OF THE INVENTION

The aim of this present invention is to provide silver halide photographic materials with which very high contrast with a gamma value exceeding 10 can be obtained using stable development baths, with which there is little pin-holing, and which have good dimensional stability.

The above mentioned aim of the invention has been realized by means of a silver halide photographic material which has at least one silver halide emulsion layer on a support, wherein there is incorporated at least one electrically conductive layer of which the surface resistance is not more than $10^{12}$ under conditions of 25° C., 25% RH, which photographic material has been dried out at a relative humidity of not more than 50% when the water content is not more than 300 wt% with respect to the total dry weight of the binder included in the silver halide emulsion layers and other hydrophilic layers on the support, which was subjected, after drying, to a heat treatment of duration at least 6 hours at a temperature of at least 30° C. in an atmosphere of absolute humidity not more than 0.01, and which has been stored under conditions of absolute humidity not more than 0.01.

DETAILED DESCRIPTION OF THE INVENTION

Electrically conductive metal oxides or electrically conductive polymeric compounds can be used as the electrically conductive materials which are used in the conductive layers of this invention.

The use of crystalline metal oxides for the electrically conductive metal oxides used in the invention is preferred, but those which have oxygen defects and those which contain small amounts, with respect to the metal oxide which is being used, of different atoms which form donors have, in general, higher electrical conductivities and are most desirable. The latter are especially desirable since they do not contribute to fogging in silver halide emulsions. Examples of metal oxides include ZnO, $TiO_2$, $SnO_2$, $Al_2O_3$, $In_2O_3$, $SiO_2$, MgO, BaO, $MoO_3$ and $V_2O_5$, or complex oxides of these oxides, and of these oxides the use of ZnO, $TiO_2$ and $SnO_2$ is especially desirable. Examples of the effective inclusion of different atoms include the addition of Al or In, for example, to ZnO, the addition of Sb, Nb, Sb or halogens to $SnO_2$ and the addition of Nb or Ta, for example, to $TiO_2$. The amount of the different atom included is preferably within the range from 0.01 mol% to 30 mol%, and most desirably within the range from 0.1 mol% to 10 mol% based on the amount of metal oxide.

The fine metal oxide particles of this invention are electrically conductive, and they have a volume resistivity of not more than $10^7$ Ω·cm, and preferably of not more than $10^5$ Ω·cm.

Such oxides have been disclosed, for example, in JP-A-56-143431, JP-A-56-120519 and JP-A-58-62647.

Moreover, electrically conductive materials in which the above mentioned metal oxides are attached to some other crystalline metal oxide particles or fibrous materials (for example titanium oxide), as disclosed in JP-B-59-6235, can also be used for this purpose.

The size of the particles used is preferably not more than 10 μ, and the stability of the particles after dispersion is good with particle sizes of not more than 2 μ and these materials are easy to use. Moreover, it is possible to form transparent photosensitive material if electrically conductive particles of not more than 0.5 μ are used, and this is especially desirable.

Furthermore, when the electrically conductive material is needle like or fibrous, the length of the particles is preferably not more than 30 μm and the diameter is preferably not more than 2 μ, and most desirably the length is not more than 25 μm and the diameter is not more than 0.5 μ, and the length/diameter ratio is at least 3.

Preferred examples of the electrically conductive polymeric materials which can be used in the invention include poly(vinylbenzene sulfonates), poly(vinylbenzyltrimethylammonium chloride), the quaternary salt polymers disclosed in U.S. Pat. Nos. 4,108,802, 4,118,231, 4,126,467 and 4,137,217, and the polymer latexes disclosed, for example, in U.S. Pat. No. 4,070,189, West German OLS 2,830,767, JP-A-61-296352 and JP-A-61-62033.

Actual examples of electrically conductive polymeric compounds of this invention are indicated below, but the invention is certainly not limited by these examples.

P-1

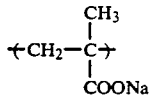

P-2

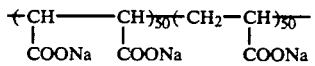

P-3

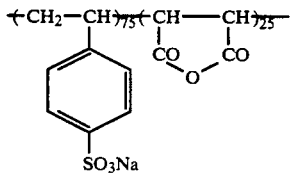

P-4

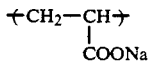

P-5

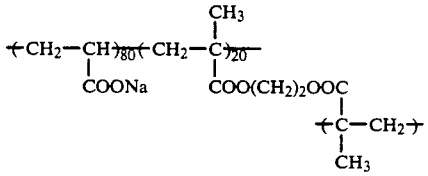

P-6

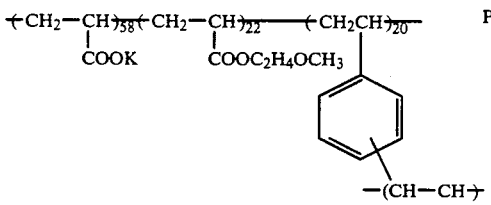

P-7

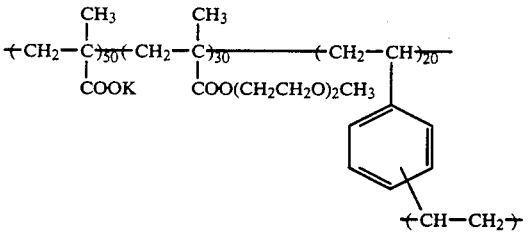

The electrically conductive metal oxide compounds or electrically conductive polymeric materials of this invention are dispersed or dissolved in a binder for use.

No particular limitation is imposed upon the binder provided that it can be formed into a film, and gelatin, proteins such as casein, cellulose compounds such as carboxymethyl cellulose, hydroxyethylcellulose, acetylcellulose, diacetylcellulose and triacetylcellulose, dextran, agar, sodium alginate and saccharides such as starch derivatives, and synthetic polymers such as poly(vinyl alcohol), poly(vinyl acetate), poly(acrylic acid esters), poly(methacrylic acid esters), polystyrene, polyacrylamide, poly(N-vinylpyrrolidone), polyesters, poly(vinyl chloride) and poly(acrylic acid), for example, can be used as binders.

The use of gelatin (lime treated gelatin, acid treated gelatin, enzyme treated gelatin, phthalated gelatin or acetylated gelatin), acetylcellulose, diacetylcellulose, triacetylcellulose, poly(vinyl acetate), poly(vinyl alcohol), poly(butyl acrylate), polyacrylamide and dextran, for example, is especially desirable.

The a high volume fraction of electrically conductive material in the conductive layer is preferred so that the electrically conductive metal oxide or electrically conductive polymeric compound of this invention is used more effectively and the resistance of the conductive layer is reduced, but the inclusion of at least about 5 vol% of binder is required to provide the layer with sufficient strength. Hence, the volume fraction of the electrically conductive metal oxide or electrically conductive polymeric compound is preferably within the range from 5 to 95 vol%.

The amount of electrically conductive metal oxide or electrically conductive polymeric compound used in this invention is preferably from 0.05 to 20 grams, and most desirably from 0.1 to 10 grams, per square meter of photographic material. The surface resistance of the conductive layer of this invention is less than $10^{12}$ Ω, and preferably less than $10^{11}$ Ω, in an atmosphere of 25° C., 25% RH. Good anti-static properties are obtained in this way.

At least one electrically conductive layer which contains an electrically conductive metal oxide or electrically conductive polymeric compound of this invention is established as a structural layer of the photosensitive material in this present invention. For example, it may take the form of a surface protective layer, a backing layer, an intermediate layer or an underlayer, and two or more such layers can be established, as required.

Good anti-static properties can be obtained by using a fluorine-containing surfactant conjointly in addition to the above mentioned electrically conductive materials in this invention.

The preferred fluorine-containing surfactants for use in the invention are surfactants which have a fluoroalkyl, fluoroalkenyl or fluoroaryl group which has at least 4 carbon atoms, and which have, as ionic groups, anionic groups (for example, sulfonic acid or salts thereof, sulfuric acid or salts thereof, carboxylic acid or salts thereof, phosphoric acid or salts thereof), cationic groups (for example, amine salts, ammonium salts, aromatic amine salts, sulfonium salts, phosphonium salts), betine groups (for example, carboxyamine salts, carboxyammonium salts, sulfoamine salts, sulfoammonium salts, phosphoammonium salts), or non-ionic groups (substituted or unsubstituted poly(oxyalkylene) groups, polyglyceryl groups or sorbitane residual groups).

Such fluorine containing surfactants have been disclosed, for example, in JP-A-49-10722, British Patent 1,330,356, U.S. Pat. Nos. 4,335,201 and 4,347,308, British Patent 1,417,915, JP-A-55-149938, JP-A-58-196544 and British Patent 1,439,402.

Actual examples of these materials are indicated below.

$C_8F_{17}SO_3K$ F-1

$C_8F_{17}SO_2N(C_3H_7)-CH_2COOK$ F-2

$C_8F_{17}SO_2N(C_3H_7)-(CH_2CH_2O)_4-(CH_2)_4SO_3Na$ F-3

-continued

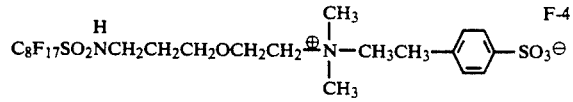

No limitation is imposed upon the layer to which the fluorine-containing surfactant is added in this invention provided that it is included in at least one layer of the photographic material, and it can be included, for example, in a surface protecting layer, an intermediate layer, an underlayer or a backing layer. It is, however, preferably added to a surface protective layer, and it may be added to the protective layer on the emulsion layer side or the protective layer on the backing layer side,. or it may be added to the protective layers on both sides.

In those cases where the surface protective layer is comprised of two or more layers, the fluorine-containing surfactant can be added to all of these layers, or it may be used in the form of an over-coat over the surface protective layer.

The amount of fluorine-containing surfactant used in this invention should be from 0.0001 to 1 gram, preferably from 0.0002 to 0.25 gram, and most desirably from 0.0003. to 0.1 gram, per square meter of photosensitive material.

Furthermore, two or more of the fluorine-containing surfactants of this invention can be mixed together.

Other antistatic agents can be used in the layers which contain the fluorine-containing surfactants, or in other layers, in this invention and even better antistatic effects can be realized in this way.

In this invention, when drying the hydrophilic colloid layer coating liquid after coating, the water content of less than 300 wt% based on the dry weight of binder must be dried-out under conditions of relative humidity not more than 50%. In cases where the hydrophilic colloid layer coating liquid has a water content in excess of 300 wt% based on the dry weight of binder, the latter part of the drying after the water content has reached 300 wt% must be carried out by drying at a relative humidity of not more than 50%.

In cases where two or more hydrophilic colloid layers are coated and dried at the same time, the water content is the sum of the water contents of all the layers and the dry weight of the binder is the sum of dry weights of the binder in all the layers.

The term "relative humidity" in this invention signifies the ratio of the water vapor content in a fixed volume of air and the saturated water vapor content of the same volume of air expressed as a percentage.

A temperature within the range from 25° C. to 50° C. is normally preferred when drying out the water content of less than 300 wt% based on the dry weight of binder in this invention.

"Drying" in this invention signifies reducing the water content to the extent that the surface of the photosensitive material is not tacky, the water content preferably being reduced to less than 15 wt%, and most desirably being reduced to less than 10 wt%, based on the dry weight of the binder.

The heat treatment of this invention must be carried out at a temperature of at least 30° C., and it is preferably carried out at a temperature of at least 35° C. but not more than 50° C., and most desirably it is carried out a temperature of at least 35° C. but not more than 45° C. The heat treatment time must be at least 6 hours and the effect of the invention is not realized satisfactorily with shorter heat treatment periods.

The heat treatment of this invention can be carried out at any time after coating and drying the silver halide photographic material. In general, silver halide photographic materials are made by temporarily rolling them up after coating and drying, and then cutting them to the prescribed size and packaging then for use. Hence, provided that the silver halide photographic material is stored under conditions of absolute humidity not more than 0.01, the heat treatment of this invention can be carried out when the photosensitive material has been rolled up after coating and drying, when the material has been cut, or when the material has been packaged.

The humidity during the heat treatment must be an absolute humidity of not more than 0.01, and most desirably it is carried out at an absolute humidity of not more than 0.008. The absolute humidity of air is defined as the ratio of the weight of water vapor in the air to the weight of air and, for example, an absolute humidity of 0.01 corresponds to a relative humidity of 50% at 25° C. and a relative humidity of about 21% at 40° C.

In this invention, the silver halide photographic material must be stored under conditions of absolute humidity not more than 0.01. This means that the photosensitive material is to be stored under the conditions of this invention until it is used by the general user.

Methods in which silver halide photographic material which has stood for a sufficient time (e.g., more than 2 hours) in an atmosphere at this temperature and humidity is sealed in a package using moisture-proof packaging materials can be used for this purpose. Alternatively, methods in which a core or paper of which the water content has been reduced beforehand is packaged together with the silver halide photosensitive material so that temperature and humidity inside the package after sealing provides an absolute humidity of not more than 0.01 can be adopted.

Furthermore, methods in which drying agents such as silica gel are sealed into the packets along with the silver halide photographic material can also be used effectively.

The packaging for sealing-in the silver halide photographic materials of this invention may have any form provided that the silver halide material can be sealed inside, and various forms of packaging can be used depending of the application and form of the photosensitive material which is being sealed inside the packaging. Normally, bags formed by heat sealing are preferred. The material from which the bags are made is preferably a polyethylene film which has a low moisture permeability (carbon black may be included in the polyethylene to provide light shielding properties and substances which have no adverse effect on photosensitive materials can also be included to provide the surface of the polyethylene with the required slip properties). Bags which have a thin laminated aluminum film are another preferred embodiment of bags for packaging purposes. Preferred examples of such packaging bags include those disclosed, for example, in JP-A-57-6754, JP-A-58-132555 and JP-A-61-189936.

The packaging can be carried out under reduced pressure in order to reduce the amount of air in the bags when silver halide photographic materials of this invention are packaged in bags of this type.

Thus, in this invention, the photosensitive material must be kept under an atmosphere of absolute humidity not more than 0.01 during the period prior to use by the general user.

Polyesters can be used as supports in this invention and are formed principally from aromatic dibasic acids and glycols. Examples of typical dibasic acids include terephthalic acid, isophthalic acid, p-β-oxyethoxybenzoic acid, diphenylsulfone dicarboxylic acid, diphenoxyethane dicarboxylic acid, adipic acid, sebacic acid, azeleic acid, 5-sodiumsulfo-isophthalic acid, diphenylene dicarboxylic acid and 2,6-naphthalene dicarboxylic acid, and typical examples of glycols include ethylene glycol, propylene glycol, butanediol, neopentylene glycol, 1,4-cyclohexanediol, 1,4-cyclohexane dimethanol, 1,4-bisoxyethoxybenzene, bisphenol A, diethylene glycol and other polyethylene glycols.

Poly(ethylene terephthalate) is the most desirable of the polyesters formed from these components, since it is easily obtained.

No particular limitation is imposed on the thickness of the polyester film, but film of thicknesses from about 12 μ to 500 μ, and preferably from 40 μ to 200 μ are convenient in view of their ease in handling and general applicability. Films which have been biaxially extended and crystallized are especially desirable in view of their stability and strength. The polyester supports of this invention may be coated with an underlayer which contains, for example, gelatin, styrene/butadiene copolymer, vinylidene chloride, aqueous polyester or aqueous polyurethane, as required, before coating the hydrophilic colloid layers. The use of underlayers containing vinylidene chloride is especially desirable and this, in conjunction with this invention, provides a remarkably good dimensional stability improving effect. Furthermore, the surface of the polyester film may be subjected to a coronal treatment or a glow discharge treatment, for example, before establishing these underlayers by coating.

Layers which have a hydrophilic binder, such as gelatin, are used for backing layers, and these are non-photosensitive layers. These layers may have a single layer structure or a multi-layer structure which contains intermediate layers and protective layers.

The thickness of the backing layer is from 0.1 μ to 10 μ, and, as in the case of the silver halide emulsion layers and surface protective layers, these layers may contain gelatin hardening agents, surfactants, matting agents, colloidal silica, slip-agents, UV absorbers, dyes and viscosity increasing agents, for example, as required.

The hydrazine derivatives which can be used to provide a high contrast image in this invention can be represented by the general formula (I) indicated below.

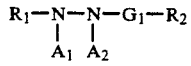

$$R_1-\underset{A_1}{N}-\underset{A_2}{N}-G_1-R_2 \qquad (I)$$

In this formula, $R_1$ represents an aliphatic group or an aromatic group, $R_2$ represents a hydrogen atom, an alkyl group, an aryl group, an alkoxy group, an aryloxy group, an imino group, a carbamoyl group or an oxycarbonyl group, $G_1$ represents a carbonyl group, a sulfonyl group, a sulfoxy group, a

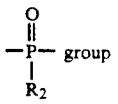

group or an iminomethylene group, and $A_1$ and $A_2$ both represent hydrogen atoms or one represents a hydrogen atom and the other represents a substituted or unsubstituted alkylsulfonyl group, a substituted or unsubstituted arylsulfonyl group or a substituted or unsubstituted acyl group.

The aliphatic groups represented by $R_1$ in general formula (I) are preferably groups which have from 1 to 30 carbon atoms, and they are most desirably linear chain, branched or cyclic alkyl groups which have from 1 to 20 carbon atoms. Here, the cyclic alkyl groups may be cyclyzed so as to form saturated heterocyclic rings which contain within them one or more hetero atoms. Furthermore, the alkyl groups may have substituent groups of 1 to 60 carbon atoms and preferably 1 to 40 carbon atoms, such as aryl groups, alkoxy groups, sulfoxy groups, sulfonamido groups and carbonamido groups.

In formula (I), the aromatic group represented by $R_1$ can be a monocyclic or bicyclic aryl group or an unsaturated heterocyclic group. The unsaturated heterocyclic group may be bonded with a monocyclic or bicyclic aryl group to form a hetero aryl group. Examples of such groups include benzene rings, naphthalene rings, pyridine rings, pyrimidine rings, imidazole rings, pyrazole rings, quinoline rings, isoquinoline rings, benzimidazole rings, thiazole rings and benzothiazole rings, among which those containing benzene rings are preferred.

Aryl groups are particularly preferred as $R_1$.

The aryl group or unsaturated heterocyclic group of $R_1$ may be substituted, and representative substituents include straight chain, branched or cyclic alkyl groups (preferably those having of 1 to 20 carbon atoms), aralkyl groups (preferably monocyclic or bicyclic groups whose alkyl moieties have 1 to 3 carbon atoms), alkoxy groups (preferably those having 1 to 20 carbon atoms), substituted amino groups (preferably amino groups substituted with alkyl groups having 1 to 20 carbon atoms), acylamino groups (preferably having 2 to 30 carbon atoms), sulfonamido groups (preferably those having 1 to 30 carbon atoms), and ureido groups (preferably those having 1 to 30 carbon atoms).

The alkyl group represented by $R_2$ in formula (I) preferably is an alkyl group with 1 to 4 carbon atoms, and may be substituted with substituent groups such as halogen atoms, cyano groups, carboxy groups, sulfo groups, alkoxy groups and phenyl groups.

The aryl group represented by $R_2$ preferably is a monocyclic or bicyclic aryl group, for example, a benzene ring. The aryl group may be substituted with, for example, halogen atoms, alkyl groups, cyano groups, carboxyl groups and sulfo groups.

Alkoxy groups having 1 to 8 carbon atoms are preferred as the alkoxy group, and such may be substituted with halogen atoms and aryl groups.

Monocyclic groups are preferred as the aryloxy group, and such may be substituted with halogen atoms.

Preferred amino groups include an unsubstituted amino group, alkylamino groups having 1 to 10 carbon atoms and arylamino groups, and they may be substituted with alkyl groups, halogen atoms, cyano groups, nitro groups and carboxy groups.

Preferred carbamoyl groups are an unsubstituted carbamoyl group, alkylcarbamoyl groups having 2 to 10 carbon atoms and arylcarbamoyl groups, and they may be substituted with alkyl groups, halogen atoms, cyano groups and carboxy groups.

Preferred oxycarbonyl groups are aryloxycarbonyl groups and alkoxycarbonyl groups with 2 to 10 carbon atoms, and they may be substituted with alkyl groups, halogen atoms, cyano groups and nitro groups.

Of the groups represented by $R_2$, when $G_1$ is a carbonyl group, preferred groups are a hydrogen atom, an alkyl group (for example, methyl, trifluoromethyl, 3-hydroxypropyl and 3-methanesulfonamidopropyl), an aralkyl group (for example, o-hydroxybenzyl) and an aryl group (for example, phenyl, 3,5-dichlorophenyl, o-methanesulfonamidophenyl and 4-methanesulfonylphenyl), with a hydrogen atom being preferred.

When $G_1$ is a sulfonyl group, it is preferred that $R_2$ be an alkyl group (for example, methyl), an aralkyl group (for example, o-hydroxyphenylmethyl), an aryl group (for example, phenyl), or a substituted amino group (for example, dimethylamino).

When $G_1$ is a sulfoxy group, it is preferred for $R_2$ to be a cyanobenzyl group or a methylthiobenzyl group.

When $G_1$ is a

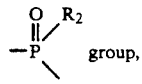

group, group, it is preferred that $R_2$ be a methoxy group, an ethoxy group, a butoxy group, a phenoxy group or a phenyl group, with a phenoxy group being especially preferred.

When $G_1$ is an N-substituted or unsubstituted iminomethylene group, $R_2$ preferably is a methyl group, an ethyl group, or a substituted or unsubstituted phenyl group.

The substituent groups cited relative to $R_1$ above can be substituents for the $R_2$ substituted group, but others can also be used, such as acyl groups, acyloxy groups, alkoxycarbonyl groups, aryloxycarbonyl groups, alkenyl groups, alkynyl groups and nitro groups.

Carbonyl groups are most preferred as the G of formula (I).

Also, $R_2$ may be a moiety that will cleave the $—G_1—R_2$ moiety from the residual molecules and bring about a cyclization reaction to form a cyclic structure containing the atoms of the $—G—R_2$ moiety, that can represented by formula (a).

$$—R_3—Z_1 \qquad \text{(a)}$$

wherein $Z_1$ is a group capable of nucleophilically attacking $G_1$, and is a group that cleaves the $G_1—R_3—Z_1$ moiety from the residual molecules, and $R_3$ is a group removing a hydrogen atom from the group of $R_2$ and allowing $Z_1$ to attack $G_1$ nucleophilically to form a cyclic structure with $G_1$, $R_3$ and $Z_1$.

In further detail, $Z_1$ is a group capable of releasing the $R_1—N=N$ group from $G_1$ by nucleophilic reaction with the intermediate having the following formula formed upon oxidation of the hydrazine compound of formula (I).

$R_1—N=N—G_1—R_3—Z_1$

More specifically, $Z_1$ may be a functional group that reacts directly with $G_1$ such as —OH, —COOH, —SH or —$NHR_4$, wherein $R_4$ is a hydrogen atom, an alkyl group of 1 to 30 carbon atoms (e.g., methyl, ethyl), an aryl group of 6 to 20 carbon atoms (e.g., phenyl, naphthyl), —$COR_5$ or —$SO_2R_5$, and $R_5$ represents a hydrogen atom, an alkyl group of 1 to 30 carbon atoms (e.g., methyl, ethyl), an aryl group of 6 to 20 carbon atoms (e.g., phenyl, naphthyl) or a hetero cyclic group of 1 to 20 carbon atoms (e.g., pyridyl). Here, $Z_1$ may be a temporarily protected precursor that form —OH, —COOH, —SH or —$NHR_4$ upon hydrolysis with alkali. $Z_1$ may also be a functional group capable of reacting with $G_1$ by reacting with nucleophilic agents such as sulfite ions and hydroxide ions such as $$-\overset{O}{\overset{\|}{C}}-R_6-\overset{N-R_7}{\overset{\|}{C}}-R_6$$

wherein $R_6$ and $R_7$ each represents a hydrogen atom, an alkyl group of 1 to 30 carbon atoms (e.g., methyl, ethyl), an alkenyl group of 2 to 30 carbon atoms, an aryl group of 6 to 20 carbon atoms (e.g., phenyl, naphthyl) or a hetero cyclic group of 1 to 20 carbon atoms (e.g., pyridyl).

Preferred cyclic groups for forming $G_1$, $R_3$ and $Z_1$ are 5-membered or 6-membered rings. Of those represented by formula (a), those represented by formulas (b) and (c) are preferred.

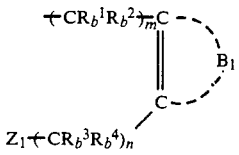

(b)

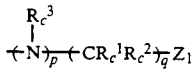

(c)

In formula (b), $R_b^1$ to $R_b^4$ which may be the same or different, each represents a hydrogen atom, an alkyl group (preferably with 1 to 12 carbon atoms), an alkenyl group (preferably with 2 to 12 carbon atoms) and an aryl group (preferably with 6 to 12 carbon atoms); $B_1$ represents atoms needed to complete a 5-membered or 6-membered ring which may be substituted; and m and n are 0 or 1 and (n+m) is 1 or 2. $Z_1$ is the same as in general formula (a).

Examples of suitable 5-membered or 6-membered ring formed by $B_1$ are a cyclohexene ring a cycloheptene ring, a benzene ring , a naphthalene ring, a pyridine ring and a quinoline ring.

In formula (c), $R_c^1$ and $R_c^2$ which may be the same or different, each represents a hydrogen atom, an alkyl group of 1 to 30 carbon atoms (e.g., methyl, ethyl), an alkenyl group of 2 to 30 carbon atoms, an aryl group of 6 to 20 carbon atoms (e.g., phenyl) or halogen atom; $R_c^3$ represents a hydrogen atom, an alkyl group of 1 to 30 carbon atoms (e.g., methyl, ethyl), an alkenyl group of 2 to 30 carbon atoms or an aryl group of 6 to 20 carbon atoms (e.g., phenyl); p is 0 or 1; and q is 1 to 4. $Z_1$ is the same as in formula (a).

$R_c^1$, $R_c^2$ and $R_c^3$ may combine and form a ring so long as a structure where $Z_1$ is capable of intramolecular nucleophilic attack on $G_1$ exists.

$R_c^1$ and $R_c^2$ are preferably hydrogen atoms, halogen atoms or alkyl groups, and $R_c^3$ is preferably an alkyl group or an aryl group.

q preferably is 1 to 3, and, when q is 2 or 3, $CR_c^1R_c^2$ may be the same or different.

$A_1$ and $A_2$, which may be the same or different, each represents a hydrogen atom, an alkylsulfonyl group with 20 or less carbon atoms and an arylsulfonyl groups (preferably a phenylsulfonyl group or a phenylsulfonyl group substituted in a manner that the sum of Hammett's substituent constant is not less than −0.5), an acyl group with 20 or less carbon atoms such as a benzoyl group, a benzoyl group substituted in a manner that the sum of Hammett's substituent constant is not less than −0.5 and an unsubstituted or substituted straight chain, branched or cyclic aliphatic acyl groups (where the substituent groups may be, for example, halogen atoms, ether groups, sulfonamide groups, carbonamide groups, hydroxyl groups, carboxy groups and sulfonic acid groups).

$A_1$ and $A_2$ are most preferably hydrogen atoms.

$R_1$ or $R_2$ of formula (I) may contain a ballast group conventionally used in immobile photographic additives such as couplers. The ballast group is a group that is comparatively inert photographically, has 8 or more carbon atoms, and can be selected, for example, from alkyl groups, alkoxy groups, phenyl groups, alkylphenyl groups, phenoxy groups and alkylphenoxy groups.

$R_1$ or $R_2$ of formula (I) may contain groups that enhance the adsorptivity on silver halide grain surfaces. Suitable adsorbing groups include thiourea groups, heterocyclic thioamido groups, mercapto heterocyclic groups and triazole groups as described in U.S. Pat. Nos. 4,385,108 and 4,459,347, and in JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, and in Japanese Patent Application Nos. 62-67501 and 62-67510.

Specific examples of compounds represented by formula (I) are given below. However, the present invention is not to be construed as being limited to compounds shown below.

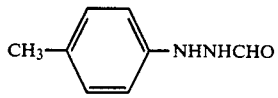

I-1)

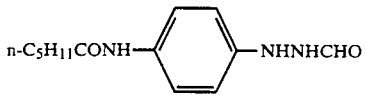

I-2)

-continued
I-3)
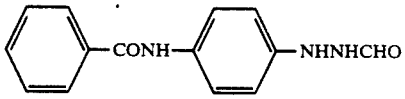
I-4)
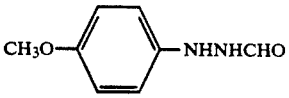
I-5)
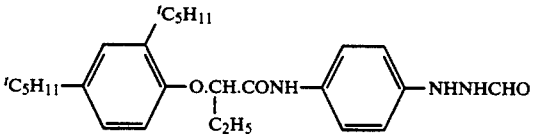
I-6)
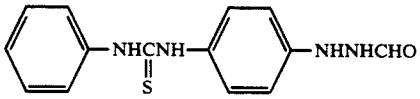
I-7)
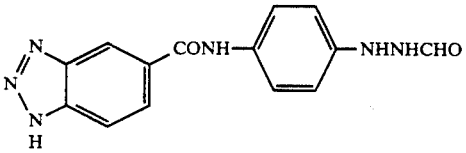
I-8)
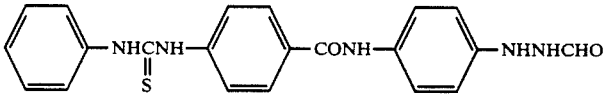
I-9)
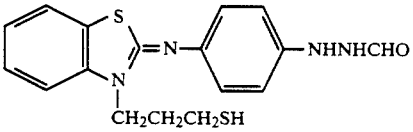
I-10)
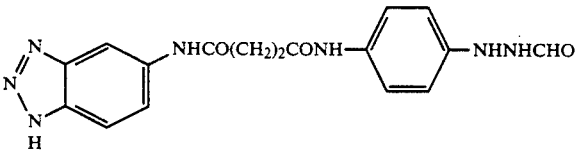
I-11)
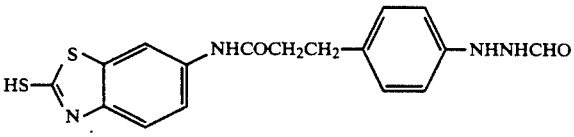
I-12)
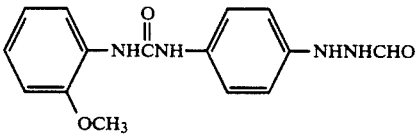
I-13)
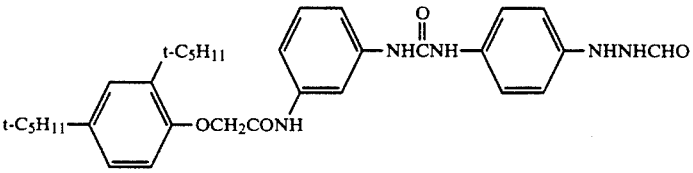

-continued
I-14)
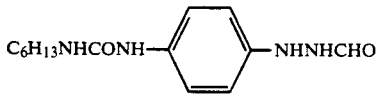
I-15)
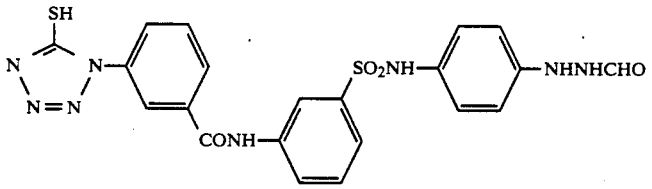
I-16)
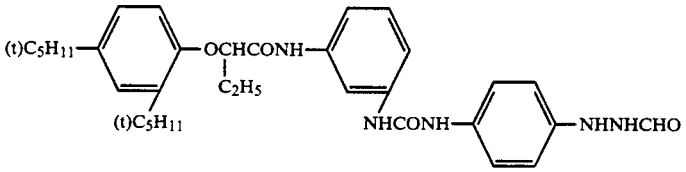
I-17)
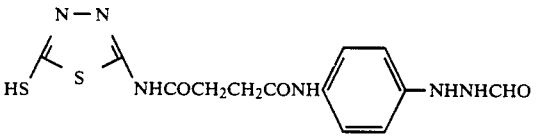
I-18
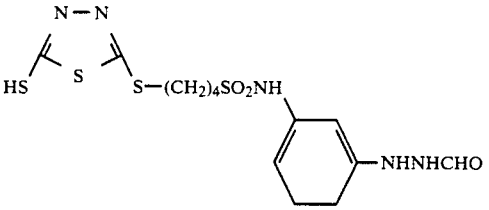
I-19)
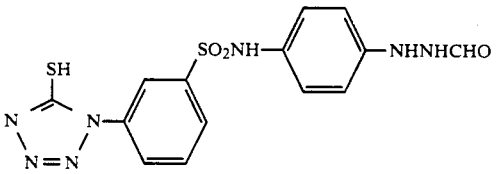
I-20)
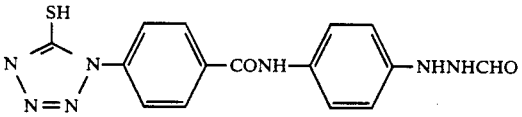
I-21)
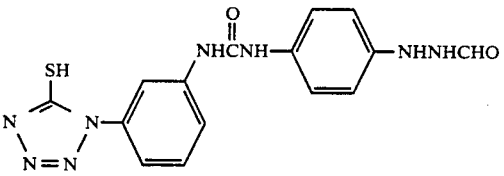
I-22)
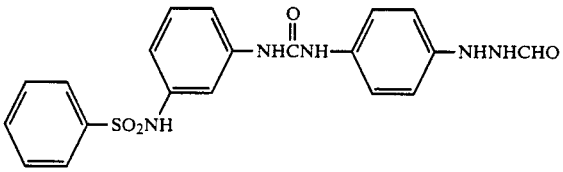

-continued
I-23)
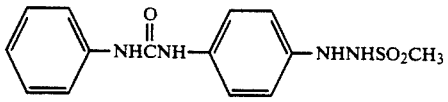
I-24)
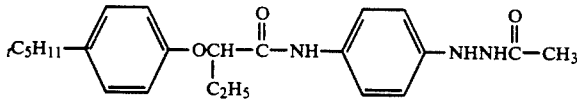
I-25)
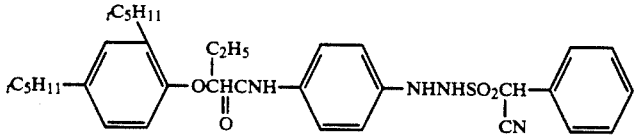
I-26)
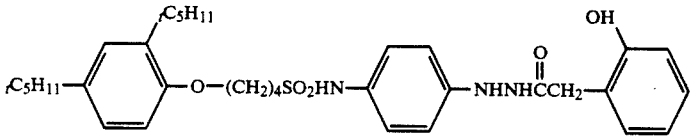
I-27)
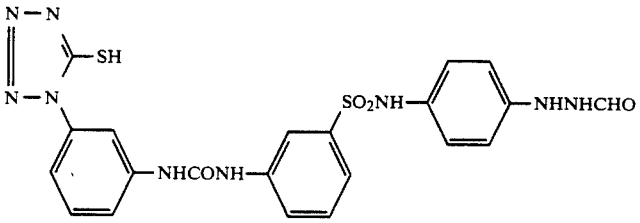
I-28)
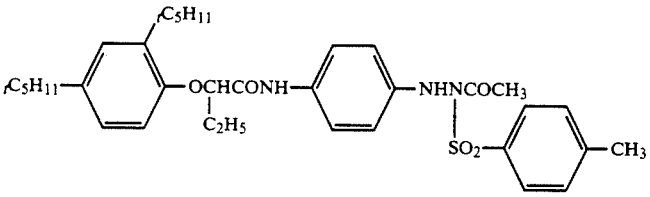
I-29)
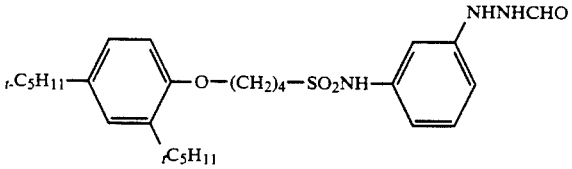
I-30)
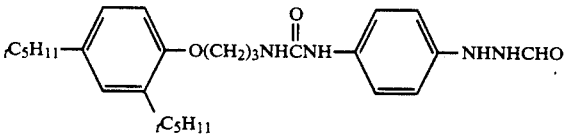
I-31)
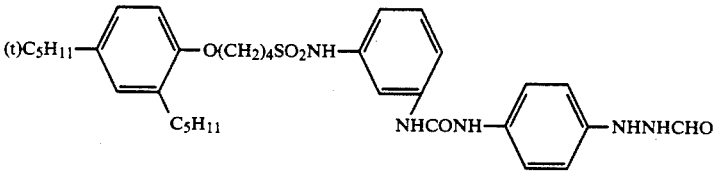
I-32)
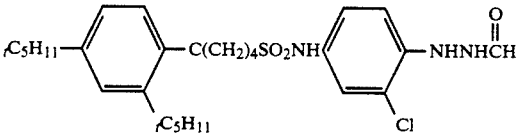

-continued
I-33)
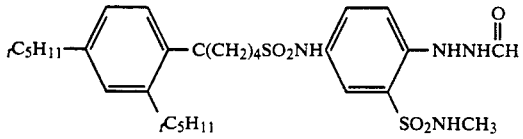
I-34)
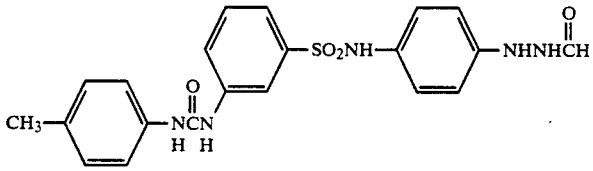
I-35)
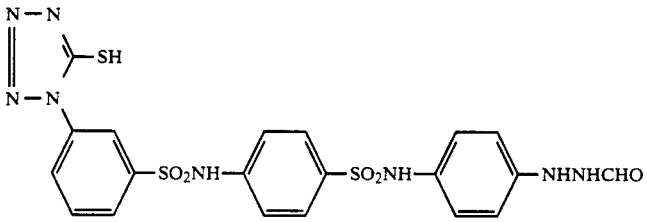
I-36)
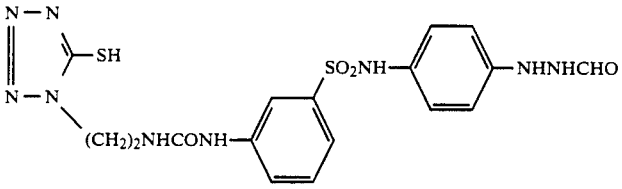
I-37)
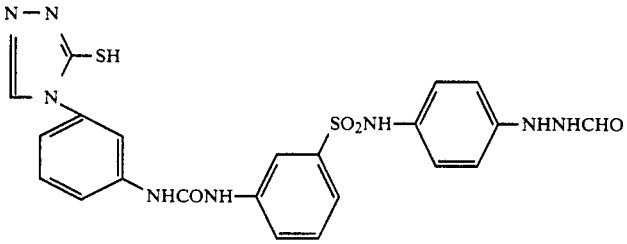
I-38)
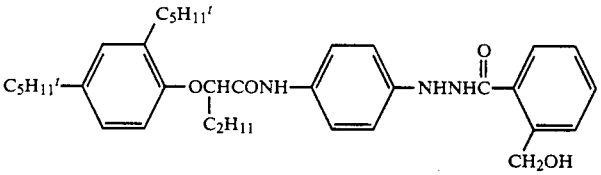
I-39)
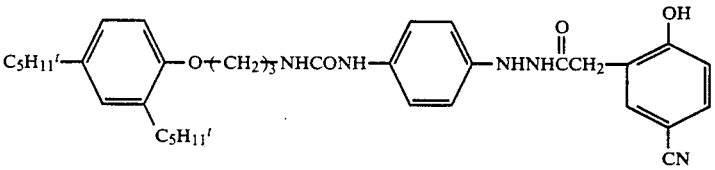
I-40)
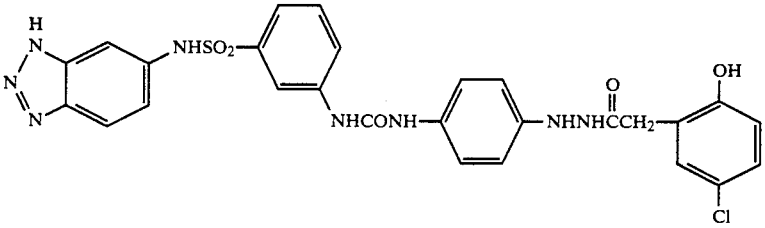

-continued

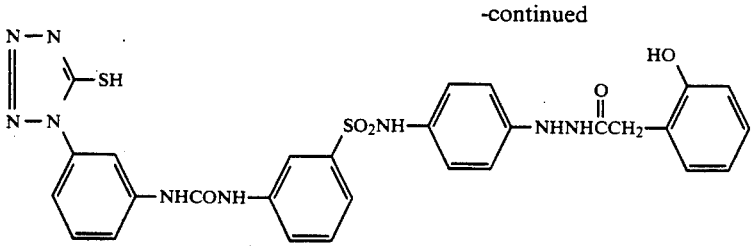

I-41)

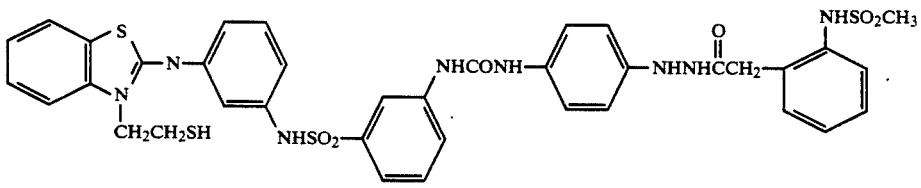

I-42)

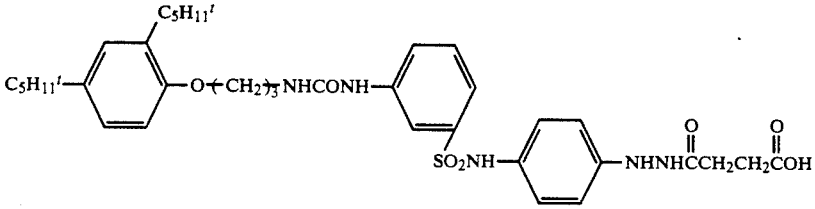

I-43)

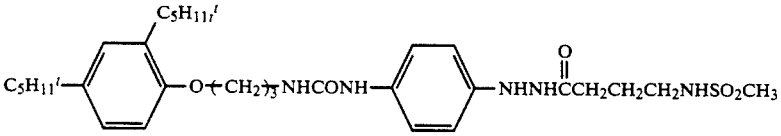

I-44)

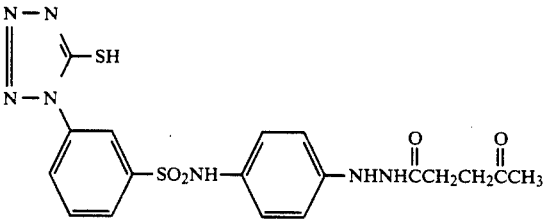

I-45)

In addition to the above, it is also possible to use, as the hydrazine derivatives of the present invention, those disclosed in the references cited in *Research Disclosure Item* 23516 (November, 1983, page 346), and those described in U.S. Pat. Nos. 4,080,207, 4,269,929, 4,276,364, 4,278,748, 4,385,108, 4,459,347, 4,560,638 and 4,478,928, in British Patent 2,011,391B, in JP-A-60-179734, JP-A-61-170733, JP-A-61-270744, JP-A-62-948, in European Patent 217,310, and in JP-A-63-32538, JP-A-63-104047, JP-A-63-121838, JP-A-63-129337, JP-A-63-234244, JP-A-63-234245, JP-A-63-234246, JP-A-63-223744, and Japanese Patent Application Nos. 62-130819, 62-143469 and 62-166117.

The amount of the hydrazine derivative employed in the present invention is preferably $1\times10^{-6}$ mol to $5\times10^{-2}$ mol per mol of silver halide, with amounts in the range of $1\times10^{-5}$ mol to $2\times10^{-2}$ mol being particularly preferred.

Inorganic or organic gelatin hardening agents can be included in the photographic emulsion layers and non-photosensitive hydrophilic colloid layers of this invention. Examples of such agents include active vinyl compounds (for example, 1,3,5-triacryloylhexahydro-s-triazine, bis(vinylsulfonyl)methyl ether, N,N'-methylenebis[$\beta$-(vinylsulfonyl)propionamide)], active halogen compounds (for example, 2,4-dichloro-6-hydroxy-s-triazine), mucohalogenic acids (for example, mucochloric acid), N-carbamoylpyridinium salts (for example, (1-morpholinocarbonyl-3-pyridinio)methanesulfonate), haloamidinium salts (for example, 1(1-chloro-1-pyridinomethylene)pyrrolidinium 2-naphthalenesulfonate) and these agents may be used individually or in combinations. From among these hardening agents, the use of the active vinyl compounds disclosed in JP-A-53-41220, JP-A-53-57257, JP-A-59-162546 and JP-A-60-80846 and the active halogen compounds disclosed in U.S. Pat. No. 3,325,287 is preferred.

The silver halide emulsions used in the invention may be, for example, silver chloride emulsions, silver chlorobromide emulsions, silver iodobromide emulsions or silver iodochlorobromide emulsions.

The average grain size of the silver halide used in the invention is preferably fine (for example, less than 0.7 $\mu$, and grain sizes of not more than 0.5 $\mu$ are especially desirable. No particular limitation is imposed upon the grain size distribution, but the use of a mono-dispersion is preferred. Here, the term "mono-dispersion" signifies an emulsion in which 95% of the grains in terms of weight or in terms of the number of grains are of a size within $\pm40\%$ of the average grain size.

The silver halide grains in the photographic emulsion may have a regular crystalline form, such as a cubic or octahedral form, or they may have an irregular crystalline for, such as a spherical or plate-like form, or they may have a composite form comprised of these crystalline forms..

The silver halide grains may be such that the interior part and the surface layer consist of a uniform phase, or the interior part and the surface layer may consist of different phases. Use can also be made of two or more types of silver halide emulsion which have been formed separately.

Cadmium salts, sulfites, lead salts, thallium salts, rhodium salts or complex salts thereof, and iridium salts or complex salts thereof, for example, may be present in an emulsion which is used in the invention during the formation or physical ripening of the silver halide grains.

The silver halide emulsions used in the method of this invention may or may not be chemically sensitized. Chemical sensitization of the silver halide emulsions can be achieved using the known sulfur sensitization, reduction sensitization and noble metal sensitization methods, either independently or conjointly.

The use of gelatin is convenient as a binding agent or protective colloid in photographic emulsions, but other hydrophilic colloids can be used for this purpose. Thus, gelatin derivatives, graft polymers of gelatin with other polymers, proteins such as albumin and casein, cellulose derivatives such as hydroxyethylcellulose, carboxymethylcellulose and cellulose sulfate esters, sodium alginate, sugar derivatives such as starch derivatives, and a great many synthetic hydrophilic polymeric materials, such as poly(vinyl alcohol), partially acetalated poly(vinyl alcohol), poly(N-vinylpyrrolidone), poly(acrylic acid), poly(methacrylic acid), polyacrylamide, polyvinylimidazole and polyvinylpyrazole, either alone or in the form of co-polymers, can be used, for example, for this purpose.

As well as lime treated gelatins, acid treated gelatins can be used for the gelatin, and use can also be made of gelatin hydrolyzates and enzyme degradation products of gelatin.

Known spectrally sensitizing dyes may be added to the silver halide emulsions used in the invention.

Various compounds can be included in the photographic emulsions of this invention with a view to preventing the occurrence of fogging during the manufacture, storage or photographic processing of the sensitive material, or with a view to stabilizing photographic performance. Thus, many compounds which are known as anti-fogging agents or stabilizers, such as azoles, for example, benzothiazolium salts, nitroindazoles, triazoles, benzotriazoles, benzimidazoles (especially nitro- or halogen- substituted benzimidazoles), heterocyclic mercapto compounds such as the mercaptothiazoles, mercaptobenzothiazoles, mercaptobenzimidazoles, mercaptothiadiazoles, mercaptotetrazoles (especially 1-phenyl-5-mercaptotetrazole) and mercaptopyrimidines; the heterocyclic mercapto compounds indicated above which has a water solubilizing group such as a carboxyl group or a sulfo group; thioketo compounds such as, for example, oxazolinethione; azaindenes, for example, triazaindenes, tetraazaindenes (especially 4-hydroxy substituted (1,3,3a,7)tetraazaindenes); benzenethiosulfonic acids, benzenesulfinic acid, and hydroquinones, can be added for this purpose.

Various surfactants may be included in the photographic emulsion layer and other structural layers of the photosensitive materials prepared using this invention for various purposes, for example as coating promotors, as anti static agents, for improving slip properties, for emulsification and dispersion purposes, to prevent the occurrence of sticking and for improving photographic characteristics (for example, for accelerating development, increasing contrast, and increasing speed).

For example, use can be made of non-ionic surfactants such as saponin (steroid based), alkylene oxide derivatives (for example, polyethyleneglycol, polyethyleneglycol/polypropyleneglycol condensates, polyethyleneglycol alkyl ethers or polyethyleneglycol alkyl aryl ethers, polyethyleneglycol esters, polyethyleneglycol sorbitane esters, polyalkyleneglycol alkylamines or amides, and polyethyleneoxide adducts of silicones), glycidol derivatives (for example, alkenylsuccinic acid polyglyceride and alkylphenyl polyglyceride), fatty acid esters of polyhydric alcohols, and sugar alkyl esters; anionic surfactants which contain acid groups such as carboxyl groups, sulfo groups, phospho groups, sulfate ester groups or phosphate ester groups, for example, alkylcarboxylates, alkylsulfonates, alkylbenzenesulfonates, alkylnaphthalenesulfonates, alkyl sulfate esters, alkyl phosphate esters, N-acyl-N-alkyltaurines, sulfosuccinic acid esters, sulfoalkylpolyoxyethylenealkylphenyl ethers and polyoxyethylenealkyl phosphate esters; amphoteric surfactants such as amino acids, aminoalkylsulfonic acids, aminoalkyl sulfate or phosphate esters, alkylbetaines and amine oxides; and cationic surfactants, such as alkylamine salts, aliphatic or aromatic quaternary ammonium salts, heterocyclic quaternary ammonium salt such as pyridinium salts and imidazolium salts, and sulfonium or phosphonium salts which contain an aliphatic or heterocyclic ring.

The poly(alkylene oxides) of molecular weight at least 600 disclosed in JP-B-58-9412 are the preferred surfactants for use in this invention. Furthermore, polymer latexes such as poly(alkyl acrylate) latex can also be included to provide dimensional stability.

Furthermore, spherical particles of poly(methyl methacrylate) for example, or amorphous particles such as silicon dioxide for example, can be included as matting agents in order to prevent adhesion of the sensitive material with itself or to improve the correcting properties or vacuum sealing properties. The average particle size is from 0.1 $\mu$ to 10 $\mu$, and preferably from 1 $\mu$ to 5 $\mu$.

Various compounds which contain nitrogen or sulfur atoms can be used, as well as the compounds disclosed, for example, in JP-A-53-77616, JP-A-54-37732, JP-A-53-137133, JP-A-60-140340 and JP-A-60-14959, are suitable for use as development accelerators or accelerators for nucleation infectious development in this invention.

Stable development baths can be used to obtain ultra-high contrast photographic properties using silver halide photosensitive materials of this invention, and there is no need for the use of conventional infectious development baths or the highly alkaline development baths of pH approaching 13 disclosed in U.S. Pat. No. 2,419,957.

That is to say, the silver halide photosensitive materials of this invention can provide satisfactorily ultra-high contrast negative images using development baths of pH from 10.5 to 12.3, and preferably of from 11.0 to 12.0, which contain at least 0.15 mol/liter of sulfite ion as preservative.

No particular limitation is imposed upon the developing agents which can be used in the method of this invention, and use can be made, for example, of dihydroxybenzenes (such as hydroquinone), 3-pyrazolidones (such as 1-phenyl-3-pyrazolidone and 4,4-dimethyl-1-phenyl-3-pyrazolidone) and aminophenols (such as N-methyl-p-aminophenol), and these can be used individually or in combinations.

Processing in development baths which contain dihydroxybenzenes as the principal developing agent and 3-pyrazolidones or aminophenols as auxiliary developing agents is especially suitable for the silver halide photosensitive materials of this invention. Development baths in which dihydroxybenzenes at a concentration of from 0.05 to 0.5 mol/liter are used conjointly with 3-pyrazolidones or aminophenols at a concentration of not more than 0.06 mol/liter are preferred.

The rate of development can be increased and the development time can be shortened by adding amines to the development bath, as disclosed in U.S. Pat. No. 4,269,929.

Furthermore, pH buffers such as alkali metal sulfites, carbonates, borates and phosphates, and development inhibitors or anti-foggants, such as bromides, iodides and organic anti-faggants (among which the nitroindazoles or benzotriazoles are especially desirable) can also be included in the development bath. Furthermore, water softeners, dissolution promotors, toning agents, development accelerators, surfactants (among which the poly(alkylene oxides) described earlier are especially desirable), defoaming agents, film hardening agents, and agents for preventing silver contamination of the films (for example, 2-mercaptobenzimidazolesulfonic acids) can also be included, as required.

The fixing baths consist of aqueous solutions which contain thiosulfates, water soluble aluminum compounds, acetic acid and dibasic acids (for example tartaric acid, citric acid or salts of these acids), and the fixing bath pH is at least 4.4, preferably from 4.6 to 5.4, and more preferably from 4.6 to 5.0.

The pH of the fixing bath affects the swelling of the film and has a pronounced effect on the residual coloration. That is to say, if the pH exceeds 5.4, film swelling is considerable even though the prescribed film hardening agents have been added and problems arise with drying failure and improper feed in transportation, and film contamination due to precipitation of the film hardening agent occurs if large amounts of film hardening agent are introduced in order to overcome these problems. On the other hand, at pH below 4.4 there are problems with residual coloration, and at pH values of 4.0 or below problems arise with fixing failure. However, films can be fixed rapidly with little residual coloration using the above mentioned pH range and the amounts of film hardening agent of this invention.

Thiosulfates, such as sodium thiosulfate and ammonium thiosulfate, are indispensable components as fixing agents, and the use of ammonium thiosulfate is preferred from the point of view of the fixing rate. The amount of fixing agent used can be varied appropriately, but the fixing agent is generally used at a concentration of from about 0.1 to about 5 mol/liter.

In this invention, aluminum salts, chromium salts and ethylenediamine tetraacetic acid complexes with the trivalent iron compounds which act as oxidizing agents are acid hardening agents in the fixer bath.

The water soluble aluminum compounds are preferred, and these compounds include, for example, aluminum chloride, aluminum sulfate and potassium alum. The amount added is preferably from 0.01 to 0.2 mol/liter, and most desirably from 0.03 to 0.08 mol/liter.

Tartaric acid or derivatives thereof, and citric acid and derivatives thereof, can be used individually, or two or more such compounds can be used conjointly, as the dibasic acid mentioned earlier. These compounds are effective when included at a rate of at least 0.005 mol/liter of fixer bath, and they are especially effective when used at concentrations of from 0.01 to 0.03 mol/liter.

Actual examples of such compounds include for example, tartaric acid, potassium tartrate, sodium tartrate, potassium hydrogen tartrate, sodium hydrogen tartrate, potassium sodium tartrate, ammonium tartrate, potassium ammonium tartrate, potassium aluminum tartrate, potassium antimonyl tartrate, sodium antimonyl tartrate, lithium hydrogen tartrate, lithium tartrate, magnesium hydrogen tartrate, potassium boron tartrate and potassium lithium tartrate.

Examples of citric acid or derivatives thereof which are effective in the invention include citric acid, sodium citrate, potassium citrate, lithium citrate and ammonium citrate.

Preservatives (for example, sulfites and bisulfites), pH buffers (for example, acetic acid and boric acid), pH adjusting agents (for example, sulfuric acid), and chelating agents can be included, as required, in the fixing bath. Since the pH of the development baths is higher, the pH buffers are used here at concentrations of from 10 to 40 grams/liter, and preferably at a concentration of from 18 to 25 grams per liter.

As in the case of development, the fixing temperature and time are preferably from about 20° C. to about 50° C. and from 10 seconds to 1 minute respectively.

When using the method of this invention, the developed and fixed photographic materials are washed with water and dried. Water washing is carried out until the dissolved silver salts are more or less completely removed, and water washing at a temperature of from about 20° C. to about 50° C. for a period of from 10 seconds to 3 minutes is preferred. Drying is carried out at a temperature of from about 40° C. to about 100° C., and the drying time can be varied in accordance with this temperature range, but a drying time of from about 5 seconds to 3 minutes 30 seconds is usual.

Automatic processors of the roller transport type have been disclosed, for example, in U.S. Pat. Nos. 3,025,779 and 3,545,971 and in this present specification these are referred to simply as roller transport type precessors. Roller transport type processors involve the four stages of development, fixing, washing and drying and, although other processes (such as stop processes) are not excluded, these four processes are preferably used in the method of this invention.

The development and fixing process temperatures are normally selected between 18° C. and 50° C., and they are preferably between 25° C. and 43° C.

The method of development of this invention is especially suitable for rapid processing using automatic processors. Either roller transport type processors or belt transport type processors, or any other type of processor, can be used for the automatic processor. The invention is especially suitable for rapid processing in which the processing time is short, and total times of within 2 minutes, and preferably of less than 100 seconds, including from 15 seconds to 60 seconds in development, and fixing times of from 10 seconds to 40 seconds and water washing times of from 10 seconds to 60 seconds can be realized.

The compounds disclosed in JP-A-56-24347 can be used as anti-silver contamination agents in the development baths of this invention. The compounds disclosed in JP-A-61-267759 can be used as dissolution promotors which are added to the development baths. Moreover, the compounds disclosed in JP-A-60-93433 and the compounds disclosed in JP-A-62-186256 can be used as the pH buffers which are used in the development baths.

It is possible by means of this invention to obtain silver halide photographic photosensitive materials which provide on processing in stable development baths ultra-high contrast, little pin-holing, and excellent dimensional stability.

The invention is described in detail below by means of the following examples.

In these examples, the formulae of the development bath and fixed bath were as indicated below.

| Development Bath | |
|---|---|
| Hydroquinone | 50.0 g |
| N-Methyl-p-aminophenol | 0.3 g |
| Sodium hydroxide | 18.0 g |
| 5-Sulfosalicylic acid | 55.0 g |
| Potassium sulfite | 110.0 g |
| Ethylenediamine tetraacetic acid disodium salt | 1.0 g |
| Potassium bromide | 10.0 g |
| 5-Methylbenzotriazole | 0.4 g |
| 2-Mercaptobenzimidazole-5-sulfonic acid | 0.3 g |
| 3-(5-Mercaptotetrazolyl)benzene-sulfonic acid sodium salt | 0.2 g |
| N-n-Butyldiethanolamine | 15.0 g |
| Sodium toluenesulfonate | 8.0 g |
| Water to make | 1 l |
| pH (adjusted to 11.6 using potassium hydroxide) | |
| Hardening Fixer Bath | |
| Ammonium thiosulfate | 180 g |
| Sodium thiosulfate penta-hydrate | 45 g |
| Sodium sulfite | 18 g |
| Ethylene diamine tetraacetic acid | 0.4 g |
| Tartaric acid | 4.0 g |
| Glacial acetic acid | 30.0 g |
| Aluminum sulfate | 11.0 g |
| Water to make | 1 l |
| pH adjusted to 4.7 with ammonia. | |

EXAMPLE 1

An underlayer was coated on both sides of a biaxially extended poly(ethylene terephthalate) support of thickness 100 $\mu$ so as to provide a coated weight of 14 mg/m$^2$ of gelatin and a coated weight of 9 mg/m$^2$ of the reaction product of a polyamide comprised of diethylenetriamine and adipic acid, and epichlorhydrin. Next, an electrically conductive layer of formula (1) and a gelatin layer of formula (2), as indicated below, were coated on one side of the support. Moreover, the backing layer and the protective layer of formula (7) and formula (8) as indicated below were coated sequentially over these layers, and the silver halide emulsion layers and protective layers of formula (3), (4), (5) and (6) indicated below were coated sequentially on the other side of the support and dried under the conditions shown in Table 1. Samples were obtained in this way.

| Formula (1) Electrically Conductive Layer | |
|---|---|
| $SnO_2$/Sb (9/1 by weight, average particle size 0.25$\mu$, a volume resistivity 2 $\Omega \cdot$ cm) | 165 mg/m$^2$ |
| Gelatin | 19 mg/m$^2$ |
| Formula (2) Gelatin Layer | |
| Gelatin | 35 mg/m$^2$ |
| Salicylic acid | 17 mg/m$^2$ |
| Reaction product of epichlorhydrin and a polyamide comprised of diethylenetriamine and adipic acid | 6 mg/m$^2$ |
| Formula (3) Silver Halide Emulsion Layer-1 | |
| First Solution: | 300 ml of water, 9 grams of gelatin |
| Second Solution: | 100 grams of $AgNO_3$, 400 ml of water |
| Third Solution: | 37 grams of NaCl, 1.1 ml of $(NH_4)_3RhCl$, 400 ml of water |

The second and third solutions were added simultaneously at a constant rate to the first solution at 45° C. The soluble salts were then removed from this emulsion using the methods well known in the industry, after which gelatin was added and 6-methyl-4-hydroxy-1,3,3a,7-tetra-azaindene was added as a stabilizer. This emulsion was a mono-disperse emulsion of average grain size 0.20 $\mu$, and the gelatin content was 60 grams per kilogram of emulsion.

The compounds indicated below were added to the emulsion so obtained.

| | |
|---|---|
| Illustrative compound I-30 of this invention | $5 \times 10^3$ mol/mol-Ag |
| Compound-1 | 60 mg/m$^2$ |
| Compound-2 | 9 mg/m$^2$ |
| Poly(sodium styrenesulfonate) | 40 mg/m$^2$ |
| N-Oleoyl-N-methyltaurin, sodium salt | 50 mg/m$^2$ |
| 1,2-Bis(vinylsulfonylacetamido)ethane | 70 mg/m$^2$ |
| 1-Phenyl-5-mercaptotetrazole | 3 mg/m$^2$ |
| Ethyl acrylate latex (average grain size 0.05$\mu$) | 0.46 g/m$^2$ |

The coating liquid obtained in this way was coated so as to provide a coated weight of silver of 2 g/m$^2$.

Compound-1

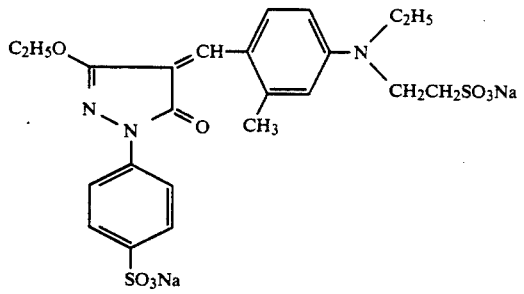

Compound-2

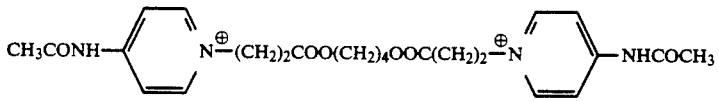

Formula (4) Silver Halide Emulsion Layer 2

| | |
|---|---|
| First Solution: | 300 ml of water, 9 grams of gelatin |
| Second Solution: | 100 grams of $AgNO_3$, 400 ml of water |
| Third Solution: | 37 grams of NaCl, 2.2 ml of $(NH_4)_3RhCl$, 400 ml of water |

An emulsion was prepared in the same way as in case of the emulsion of formula (3) by adding the second and third solution simultaneously to the first solution. This emulsion was a mono-disperse emulsion of average grain size 0.20 μ.

The compounds indicated below were added to the emulsion so obtained.

| | |
|---|---|
| Illustrative compound I-30 of this invention | $5 \times 10^{-3}$ mol/mol-Ag |
| Compound-1 | 60 mg/m$^2$ |

-continued

| | |
|---|---|
| Compound-2 | 9 mg/m$^2$ |
| Poly(sodium styrenesulfonate) | 50 mg/m$^2$ |
| N-Oleoyl-N-methyltaurin, sodium salt | 40 mg/m$^2$ |
| 1,2-Bis(vinylsulfonylacetamido)ethane | 80 mg/m$^2$ |
| 1-Phenyl-5-mercaptotetrazole | 3 mg/m$^2$ |
| Ethyl acrylate latex (average grain size 0.05μ) | 400 mg/m$^2$ |

The coating liquid so obtained was coated so as to provide a coated silver weight of 2 g/m$^2$.

| | |
|---|---|
| **Formula (5) Protective Layer-1** | |
| gelatin | 1.0 g/m$^2$ |
| Lipoic acid | 5 mg/m$^2$ |
| Sodium dodecylbenzenesulfonate | 5 mg/m$^2$ |
| Compound-3 | 20 mg/m$^2$ |
| Poly(sodium styrenesulfonate) | 10 mg/m$^2$ |
| Compound-4 | 20 mg/m$^2$ |
| Ethyl acrylate latex (average particle size 0.05μ) | 200 mg/m$^2$ |
| **Formula (6) Protective Layer** | |
| gelatin | 1.0 g/m$^2$ |
| Fine poly(methyl methacrylate) particles (average particle size 2.5μ) | 60 mg/m$^2$ |
| Sodium dodecylbenzenesulfonate | 20 mg/m$^2$ |
| N-Perfluorooctanesulfonyl-N-propylglycine, potassium salt | 3 mg/m$^2$ |
| Poly(sodium styrenesulfonic acid) | 2 mg/m$^2$ |
| Polyoxyethylene nonylphenyl ether sulfate ester, sodium salt (degree of polymerization 5) | 20 mg/m$^2$ |

Compound-3

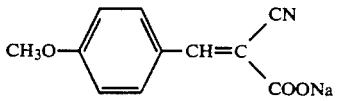

-continued

Compound-4

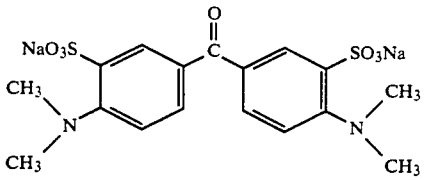

Formula (7) Backing Layer

| | |
|---|---|
| gelatin | 2.5 g/m$^2$ |
| Compound-5 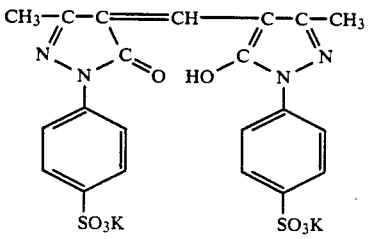 | 300 mg/m$^2$ |
| Compound-6 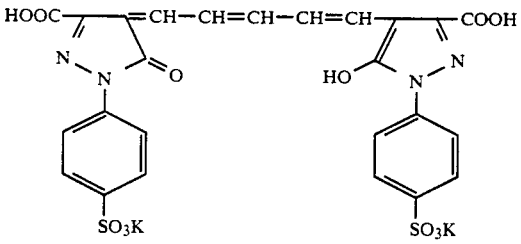 | 50 mg/m$^2$ |
| Compound-7 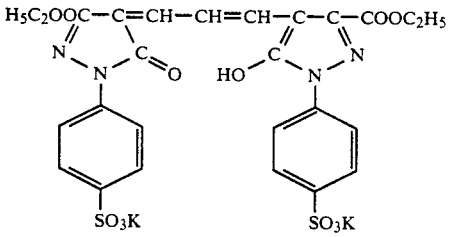 | 50 mg/m$^2$ |
| Sodium dodecylbenzenesulfonate | 50 mg/m$^2$ |
| Dihexyl-α-sulfosuccinate, sodium salt | 20 mg/m$^2$ |
| Poly(sodium styrenesulfonate) | 40 mg/m$^2$ |
| 1,3-Divinylsulfonyl-2-propanol | 150 mg/m$^2$ |
| Ethyl methacrylate latex(average particle size 0.05μ) | 500 mg/m$^2$ |

Formula (8) Protective Layer-3

| | |
|---|---|
| gelatin | 1 g/m$^2$ |
| Fine poly(methyl methacrylate) particles (average particle size 3.4μ) | 40 mg/m$^2$ |
| Sodium dodecylbenzenesulfonate | 15 mg/m$^2$ |
| Dihexyl-α-sulfosuccinate, sodium salt | 10 mg/m$^2$ |
| Poly(sodium styrenesulfonate) | 20 mg/m$^2$ |
| Sodium acetate | 40 mg/m$^2$ |

The samples obtained were cut into sheets measuring 25 cm×30 cm and heat-treated under the conditions indicated in Table 1. Subsequently, the samples were sealed into moisture-proof bags after standing for 6 hours under an atmosphere at 25° C., 40% RH (absolute humidity about 0.0079). The product (8) disclosed in Example (1) of JP-A-61-189936 was used for the moisture-proof bags.

The samples which has been sealed in the moisture-proof bags were stood for 2 weeks under an atmosphere at 25° C., after which the surface resistivity of the conductive layer, the state of occurrence of pin-holing, changes in dimensions on development processing and the absolute humidity inside the moisture-proof bag were measured using the methods described below. The results obtained are shown in Table 1.

1. Surface Resistivity

The samples were gripped between brass electrodes (the parts in contact with the sample were made of stainless steel) of length 10 cm and with an electrode spacing of 0.14 cm after standing for 12 hours under conditions of 25° C., 25% RH, and the value was measured after 1 minute using a TR8651 electrometer made by Takeda Riken.

Pin-Holing

The samples obtained were rubbed with a neoprene rubber roller in an ordinary room without any special air purification system at 25° C., 25% RH and then they were exposed and developed (38° C., 20 seconds) and the resulting materials were evaluated for the state of occurrence of pin-holing.

No problems arise in practice provided that the fractional change in dimensions is not more than ±.01%.

The development processing was carried out using an FG-660F automatic processor made by the Fuji Film Co. with development bath and fixer bath GR-D1 and GR-F1 made by the same company, and processing was carried out under conditions of 38° C., 20 seconds. The drying temperature at this time was 45° C.

Measurement of Absolute Humidity in the Moisture Proof

The relative humidity in the bag at 25° C. was measured and the absolute humidity was obtained using an air diagram. A hygrometer Model HN-$U_2$ HUMI-TEMP Recorder (made by the Chino Co.) with Sensor HN-L20 (made by the Chino Co.), was used to measure the relative humidity and the absolute humidity was calculated using the air diagram.

TABLE 1

| Sample Number | Drying Conditions: Water Content Above 300% | Drying Conditions: Water Content Below 300% | Heat Treatment Conditions: Temperature (°C.) | Heat Treatment Conditions: Absolute Humidity (%) | Heat Treatment Conditions: Time (hour) | Absolute Humidity in Packaging (100×) | Fractional Change in Dimensions (%) | Occurrence of Pin-holing*** |
|---|---|---|---|---|---|---|---|---|
| 1 (Invention) | 40° C., 20% RH | 35° C., 40% RH | 40 | 0.8 | 8 | 0.82 | 0.008 | 8 |
| 2 (Invention) | " | 35° C., 50% RH | " | " | " | 0.82 | 0.009 | 8 |
| 3 (Comp. Ex.) | " | 35° C., 60% RH | " | " | " | 0.82 | 0.020 | 8 |
| 4 (Comp. Ex.) | " | 35° C., 40% RH | 25 | " | " | 0.81 | 0.024 | 8 |
| 5 (Invention) | " | " | 30 | " | " | 0.82 | 0.011 | 8 |
| 6 (Invention) | " | " | 50 | " | " | 0.84 | 0.006 | 8 |
| 7 (Invention) | " | " | 55 | " | " | 0.84 | 0.006 | 8 |
| 8 (Comp. Ex.) | " | " | 30 | 1.2 | 4 | 0.85 | 0.025 | 9 |
| 9* (Comp. Ex.) | " | " | 40 | 0.8 | 8 | 1.38 | 0.028 | 9 |
| 10** (Comp. Ex.) | " | " | " | " | " | 0.82 | 0.009 | 100 |
| 11** (Comp. Ex.) | " | 35° C., 60% RH | " | " | " | 0.83 | 0.021 | 100 |

Surface resistivity of the electrically conductive layer (25° C., 25% RH): $2.1 \times 10^8$ Ω

*A comparative example, stood for 6 hours under an atmosphere of 25° C., 70% RH after heat treatment.

**A Comparative example from which just the electrically conductive layer had been omitted.

***The relative value when the value for the occurrence of pin-holing for sample 11 is taken to be 100.

Evaluation of Changes in Dimensions on Development Processing

Two holes of diameter 8 mm were established with a spacing of 200 mm in the sample and the distance between the two holes was measured precisely using a pin gauge of accuracy 1/1000 mm after leaving the sample to stand for 2 hours in a room at 25° C., 30% RH. The length at this time was X mm. Next, the samples were developed, fixed, water washed and dried in an automatic processor, and the distance measured 5 minutes later was Y mm. The fractional change (%) in dimensions on processing was evaluated in terms of the value $[(Y-X)/200] \times 100$.

It is clear from Table 1 that Samples 1, 2, 5, 6 and 7 of this invention gave rise to remarkably little pin-holing and exhibited little change in dimensions when developed and processed.

EXAMPLE 2

Samples were prepared in the same way as sample 1 in Example 1 except that the ratio of gelatin and electrically conductive metal oxide was changed or the electrically conductive layer was changed to an electrically conductive polymeric compound, as shown in Table 2. These samples were evaluated in respect of pin-holing and change in dimensions in the same way as in Example 1. The results obtained are shown in Table 2.

TABLE 2

| Sample Number | Electrically Conductive Layer: Electrically Conductive Material | | Electrically Conductive Layer: Gelatin | Surface Resistivity (25° C., 25% RH) (Ω) | Absolute Humidity in Packaging | Fractional Change in Dimensions (%) | Occurrence of Pin-holing** |
|---|---|---|---|---|---|---|---|
| 12 (Invention) | $SnO_2$/Sb | 165 mg/m² | 19 mg/m² | $2.1 \times 10^8$ | 0.82 | 0.008 | 6 |
| 13 (Invention) | | " | 40 mg/m² | $6.0 \times 10^8$ | 0.81 | 0.007 | 6 |
| 14 (Invention) | | " | 90 mg/m² | $3.9 \times 10^{11}$ | 0.83 | 0.008 | 7 |
| 15 (Invention) | Compound P-6 | 0.5 g/m² | 0.5 g/m² | $5.1 \times 10^{11}$ | 0.83 | 0.009 | 8 |
| 16 (Invention) | Compound P-5 | " | " | $4.8 \times 10^{11}$ | 0.84 | 0.009 | 8 |
| 17 (Invention) | Compound P-4 | " | " | $3.0 \times 10^{11}$ | 0.82 | 0.009 | 7 |
| 18 (invention) | Compound P-3 | " | " | $7.0 \times 10^{11}$ | 0.82 | 0.009 | 8 |
| 19* (Comp. Ex.) | — | | | $6.0 \times 10^{14}$ | 0.84 | 0.026 | 100 |

*Comparative example 19 was subjected to the same drying conditions and heat treatment conditions as sample 8 in Example 1.

**Relative values taking the value for the occurrence of pin-holing of comparative example 19 to be 100

It is clear from Table 2 that samples 12 to 18 of this invention showed a marked reduction in the occurrence of pin-holing and that the change in dimensions due to development processing was slight.

EXAMPLE 3

An aqueous dispersion of a copolymer comprising methyl methacrylate/butyl acrylate/acrylonitrile (45/45/10 wt%) was coated to provide a coated weight (solid fraction) of 0.3 g/m$^2$ after subjecting both sides of a support as used in Example 1 to a coronal discharge, and dried. Then, after a coronal discharge treatment, an aqueous dispersion of a copolymer comprised of vinylidene chloride/methyl methacrylate/acrylonitrile (90/8/2 wt%) was coated over this on both sides to provide a coated weight (solid fraction) of 1 g/m$^2$, and dried. Moreover, after a coronal treatment, gelatin at a rate of 0.1 g/m$^2$, compound-8 at a rate of 5 mg/m$^2$ and methylcellulose (60SH-6, made by Shin-etsu Kagaku) at a rate of 5 mg/m$^2$ was coated onto both sides and dried.

Compound-8

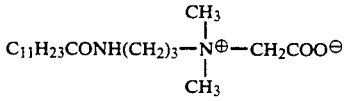

Coronal Discharge Treatment Conditions

A support of width 30 cm was treated at the rate of 20 m/min using as 6 kVA model solid state coronal discharge machine made by the Piraa Co. At this time the material was being treated at a rate of 0.375 kVA/min according to the read-off values of current and voltage. The discharge frequency during treatment was 9.6 Khz and the gap clearance h between the electrode and the dielectric roll was 1.6 mm.

The supports obtained in this way were coated sequentially in the same way sample 1 in Example 1 with an electrically conductive layer, a gelatin layer, a backing layer and a protective layer on one side and silver halide emulsion and protective layers on the other side to provide sample 20. The sample was used after aging for 2 weeks at 25° C. and evaluated in respect of pin-holing and changes in dimensions etc. in the same way as in Example 1.

The results obtained are shown in Table 3.

TABLE 3

| Sample Number | Absolute Humidity in Bag (100×) | Fractional Change in Dimensions (%) | Occurrence of Pin-holing* |
|---|---|---|---|
| 20 (Invention) | 0.82 | 0.004 | 7 |
| 1 (Invention) | 0.82 | 0.008 | 7 |
| 11 (Comp. Ex.) | 0.83 | 0.021 | 100 |

*Relative value taking the extent of pin-holing in the case of comparative example 11 to 100.

It is clear from table 3 that sample 20 which had a vinylidene chloride copolymer layer which had low moisture permeability was better in terms of the change in dimensions on development processing than sample 1 of the invention and that there was a remarkable reduction in rate of occurrence of pin-holing.

EXAMPLE 4

An underlayer was coated on both sides of a biaxially extended poly(ethylene terephthalate) support of thickness 100 μ so as to provide a coated weight of 14 mg/m$^2$ of gelatin and a coated weight of 9 mg/m$^2$ of the reaction produced of a polyamide comprised of diethylenetriamine and adipic acid, and epichlorhydrin.

Next, the electrically conductive layer of formula (1) and the gelatin layer of formula (2) as used in Example 1 were coated on one side of the support. Moreover, backing and protective layers of formulae (9) and (10) as indicated below were coated sequentially over these layers.

| | |
|---|---|
| Formula (9) | |
| gelatin | 3 g/m$^2$ |
| Compound-9 | 40 mg/m$^2$ |
| Compound-5 | 120 mg/m$^2$ |
| Compound-6 | 40 mg/m$^2$ |
| Compound-7 | 30 mg/m$^2$ |
| Sodium dihexyl-α-sulfosuccinate | 40 mg/m$^2$ |
| Sodium dodecylbenzenesulfonate | 40 mg/m$^2$ |
| 1,3-divinylsulfonyl-2-propanol | 120 mg/m$^2$ |
| Formula (10) | |
| gelatin | 0.8 g/m$^2$ |
| Fine poly(methyl methacrylate) particles (average particle size 3.4μ) | 30 mg/m$^2$ |
| Sodium dihexyl-α-sulfosuccinate | 15 mg/m$^2$ |
| Sodium dodecylbenzenesulfonate | 15 mg/m$^2$ |
| Sodium acetate | 40 mg/m$^2$ |

Compound-9

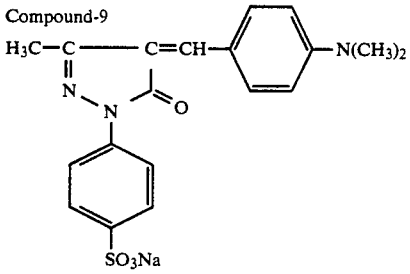

Next, a silver halide emulsion of silver iodide content 0.5 mol% and silver bromide content 99.5 mol% which contained $4\times10^{-7}$ mol per mol of silver of iridium (an un-chemically sensitized emulsion) was prepared for the other side of the support using a method well known in the industry and gelatin was added after removing the soluble salts. This was a mono-disperse emulsion of average grain size 0.28 μ and the emulsion contained 99 grams of silver and 56 grams of gelatin per kilogram of emulsion.

The sodium salt of 5,5'-dichloro-9-ethyl-3,3'-bis(3-sulfopropyl)oxacarbocyanine (1 mg/m$^2$) and the sodium salt of 3-(3-sulfopropyl)-3'-(4-sulfobutyl)-5'-phenyl-4,5-dibenzoxacyanine (6.9 mg/m$^2$) as sensitizing dyes, 6-methyl-4-hydroxy-1,3,3a,7-tetraazaindene (8 mg/m$^2$) as a stabilizer, compounds I-5 ($1.2\times10^{-3}$ mol/mol-Ag) and I-19 ($5\times10^{-5}$ mol/mol-Ag) as hydrazine derivatives, and compound-10 (5 mg/m$^2$) as a nucleation accelerator were added to this emulsion. Then 600 mg/m$^2$ of ethyl acrylate latex (average particle size 0.05 μ), 195 mg/m$^2$ of a polymer latex of compound-11, 140 mg/m$^2$ of 1,2-bis(vinylsulfonylacetamido)ethane and 12 mg/m$^2$ of the sodium salt of 2,4-dichloro-6-hydroxy-1,3,5-triazine as film hardening agents, 40 mg/m$^2$ of N-oleoyl-N-methyltaurine sodium salt as a surfactant and 20 mg/m$^2$ of poly(sodium styrenesulfonate) as a viscosity increasing agent were added.

The emulsion prepared in this way was coated at a rate of 3.5 g/m$^2$ and then layers of formulae (11) and (12) indicated below were coated sequentially over this layer as protective layers. The drying conditions at the time of coating were as shown in table 4.

| | |
|---|---|
| Formula (11) | |
| gelatin | 1.0 g/m$^2$ |
| L-Ascorbic acid | 30 mg/m$^2$ |
| Hydroquinone | 190 mg/m$^2$ |
| Ethyl acrylate latex (average particle size 0.05μ) | 240 mg/m$^2$ |
| Poly(sodium styrenesulfonate) | 3 mg/m$^2$ |
| Formula (12) | |
| gelatin | 0.6 g/m$^2$ |
| Fine poly(methyl methacrylate) particles (average particle size 2.5μ) | 60 mg/m$^2$ |
| Liquid organopolysiloxane (gelatin dispersion) | 10 mg/m$^2$ |
| Sodium dodecylbenzenesulfonate | 20 mg/m$^2$ |
| N-Perfluorooctanesulfonyl-N-propylglycine, potassium salt | 4 mg/m$^2$ |
| Colloidal silica | 90 mg/m$^2$ |

Compound-10

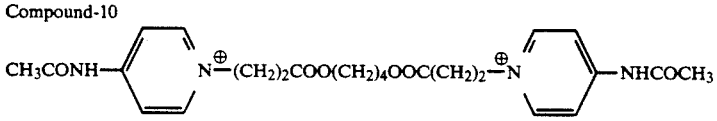

Compound-11

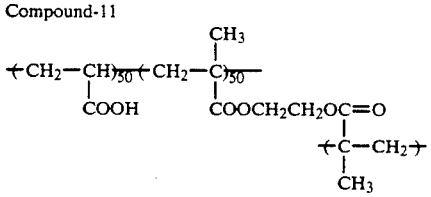

The samples obtained were heat treated under the conditions shown in Table 4 and wrapped and sealed in the same way as in Example 1. The samples were used after storing for 2 weeks at 25° C. and evaluated in respect of pin-holing and changes in dimensions in the same way as in Example 1. The results obtained are shown in Table 4.

TABLE 4

| Sample Number | Drying Conditions: Water Content Above 300% | Drying Conditions: Water Content Below 300% | Heat Treatment Conditions: Temperature (°C.) | Heat Treatment Conditions: Absolute Humidity (%) | Heat Treatment Conditions: Time (hour) | Absolute Humidity in Packaging (100×) | Fractional Change in Dimensions (%) | Occurrence of Pin-holing** |
|---|---|---|---|---|---|---|---|---|
| 21 (Comp. Ex.) | 40° C., 20% RH | 35° C., 40% RH | 25 | 0.8 | 8 | 0.82 | 0.024 | 10 |
| 22 (Invention) | " | " | 30 | " | " | 0.83 | 0.010 | 7 |
| 23 (Invention) | " | " | 40 | " | " | 0.81 | 0.008 | 6 |
| 24 (Invention) | " | " | 50 | " | " | 0.84 | 0.007 | 8 |
| 25 (Invention) | " | 35° C., 50% RH | 40 | " | " | 0.82 | 0.009 | 7 |
| 26 (Comp. Ex.) | " | 35° C., 60% RH | " | " | " | 0.83 | 0.022 | 10 |
| 27 (Comp. Ex.) | " | " | 25 | " | " | 0.82 | 0.025 | 9 |
| 28* (Comp. Ex.) | " | " | " | " | " | 0.81 | 0.025 | 100 |

*Sample 28 is a comparative sample with just the electrically conductive layer omitted from sample 27.
**Relative values taking the value for the occurrence of pin-holing with comparative sample 28 to be 100.

It is clear from Table 4 that samples 22 to 25 of this invention exhibited remarkably little pin-holing and that the change in dimension on development processing was slight.

While the invention has been described in detail and with reference to specific embodiments thereof, it will be apparent to one skilled in the art that various changes and modifications can be made therein without departing from the spirit and scope thereof.

What is claimed is:

1. A method for imparting improved dimensional stability to a silver halide photographic element, comprising providing on a support at least one hydrophilic coating layer including at least one silver halide emulsion coating layer containing binder and water, and providing at least one non-photosensitive electrically conductive layer of which the surface resistance is not more than $10^{12}$ Ω under conditions of 25° C., 25% RH, drying the photographic element at a relative humidity of not more than 50% when the water content is not more than 300 wt% with respect to the total dry weight of the binder included in said at least one silver halide emulsion coating layer and any other hydrophilic coating layers on the support, and then subjecting the photographic element, after said drying, to a separate heat treatment of a duration at least 6 hours at a temperature of at least 30° C. in an atmosphere of an absolute humidity of not more than 0.01, and then storing said photographic element under conditions of an absolute humidity of not more than 0.01.

2. A method as in claim 1 wherein said electrically conductive layer contains a metal oxide selected from metal oxides having an oxygen defect and metal oxides which contain small amounts of metal donors.

3. A method as in claim 1, wherein said metal donors are present in an amount of from 0.01 mol% to 30 mol% based on the amount of metal oxide.

4. A metal as in claim 1, wherein said metal donors are present in an amount of from 0.1 mol% to 10 mol% based on the amount of metal oxide.

5. A method as in claim 1, wherein said electrically conductive layer contains an electrically conductive polymeric compound.

6. A method as in claim 1, wherein the surface resistivity of the conductive layer is not more than $10^{11}$ ohm.

7. A method as in claim 1, wherein the support is a biaxially extended and crystallized polyester film.

8. A method as in claim 1, wherein said drying is carried out until the water content of the layers provided on the support is 15 wt% or less based on the weight of total binder in the layers provided on the support.

9. A method as in claim 1, produced by a process wherein the water content of the layers provided on the support is initially greater than 300 wt%, said photographic material is dried to 300 wt% water based on the weight of total binder in the layers provided on the support, and is then dried at a relative humidity of not more than 50%.

10. A method as in claim 1, wherein said drying out at a relative humidity of not more than 50% is continued until the water content is reduced to less than 15 wt% with respect to the total dry weight of the binder included in the silver halide emulsion layers and other hydrophilic layers on the support.

11. A method as in claim 1, wherein said drying out at a relative humidity of not more than 50% is continued until the water content is reduced to less than 10 wt% with respect to the total dry weight of the binder included in the silver halide emulsion layers and other hydrophilic layers on the support.

12. A method for imparting improved dimensional stability to a silver halide photographic element as in claim 1, where said at least one non-photosensitive electrically conductive layer contains electrically conductive metal oxides or electrically conductive polymeric compounds.

* * * * *